US009964900B2

(12) United States Patent
Yamamoto et al.

(10) Patent No.: US 9,964,900 B2
(45) Date of Patent: May 8, 2018

(54) FIXING DEVICE AND IMAGE FORMING APPARATUS

(71) Applicant: Konica Minolta, Inc., Tokyo (JP)

(72) Inventors: Koji Yamamoto, Toyokawa (JP); Mamoru Fukaya, Nagoya (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/345,788

(22) Filed: Nov. 8, 2016

(65) Prior Publication Data

US 2017/0153583 A1 Jun. 1, 2017

(30) Foreign Application Priority Data

Dec. 1, 2015 (JP) ..... 2015-234599

(51) Int. Cl.
*G03G 15/20* (2006.01)

(52) U.S. Cl.
CPC ..... *G03G 15/2028* (2013.01); *G03G 15/2035* (2013.01)

(58) Field of Classification Search
CPC ..... G03G 15/2028; G03G 15/2035; G03G 15/2085
See application file for complete search history.

(56) References Cited

U.S. PATENT DOCUMENTS 5,105,228 A 4/1992 Kato

FOREIGN PATENT DOCUMENTS

| | | | |
|---|---|---|---|
| JP | H01-082248 | A | 3/1998 |
| JP | 2002091221 | A | 3/2002 |
| JP | 2007225754 | A | 9/2007 |
| JP | 2014215355 | A | 11/2014 |
| JP | 2015028582 | A | 2/2015 |

OTHER PUBLICATIONS

Extended European Search Report dated Apr. 7, 2017, corresponding European Application No. 16197505.7-1568; Applicant: Konica Minolta, Inc.; Total of 8 pages.
Notice of Reasons for Rejection dated Jan. 9, 2018 from the corresponding Japanese Patent Application No. JP 2015-234599 and English translation.

*Primary Examiner* — Hoang Ngo
(74) *Attorney, Agent, or Firm* — Lucas & Mercanti, LLP

(57) ABSTRACT

A fixing device includes: a heating rotator and a pressure rotator configured to be pressed against and separated from each other, the rotators being rotated while being pressed against each other to thermally fix a toner image formed on a recording medium at a nip portion between the rotators; and a separating member configured to separate the recording medium to which the toner image is thermally fixed, the separating member being enabled to be brought close to and be separated from the nip portion between the rotators, wherein when the rotators in a pressure contact state are separated from each other, the rotators are separated after the separating member is moved away from the nip portion, and when the rotators in a separated state are pressed against each other, the separating member is brought close to the nip portion after the rotators are pressed against each other.

8 Claims, 9 Drawing Sheets

FIXING DEVICE AND IMAGE FORMING APPARATUS

The entire disclosure of Japanese Patent Application No. 2015-234599 filed on Dec. 1, 2015 including description, claims, drawings, and abstract are incorporated herein by reference in its entirety.

BACKGROUND OF THE INVENTION

Field of the Invention

The present invention relates to a fixing device that fixes a toner image to a recording medium, and an image forming apparatus using the fixing device, such as a copying machine, a printer, a facsimile machine, or a multifunction machine having the functions of a copying machine, a printer, and a facsimile machine. More particularly, the present invention relates to a fixing device in which a heating rotator and a pressure rotator that can be pressed against each other and be separated from each other are rotated while being pressed against each other, and a toner image formed on a recording medium is thermally fixed at a nip portion between the heating rotator and the pressure rotator. In this fixing device, a separating member for separating the recording medium having the toner image thermally fixed thereto from the nip portion can be brought close to and be moved away from the nip portion between the heating rotator and the pressure rotator. In cases where the heating rotator and the pressure rotator pressed against each other are separated from each other, and where the heating rotator and the pressure rotator in a separated state are pressed against each other, the separating member is prevented from coming into contact with the heating rotator and the pressure rotator, and from scratching these rotators.

Description of the Related Art

In a conventional image forming apparatus, such as a copying machine, a printer, a facsimile machine, or a multifunction machine having the functions of these machines, a recording medium having a toner image transferred thereonto from a photosensitive member or the like is normally guided to a fixing device, and the toner image is fixed to the recording medium by the fixing device.

In such a fixing device, a heating rotator and a pressure rotator that can be pressed against each other and be separated from each other are rotated while being pressed against each other, and a toner image formed on a recording medium is thermally fixed at the nip portion between the heating rotator and the pressure rotator.

Also, in such a fixing device, a recording medium having a toner image fixed thereto might not be appropriately separated from the nip portion between the heating rotator and the pressure rotator, and might be wound around the heating rotator or the pressure rotator. To prevent this, a separating member is provided in the vicinity of the nip portion between the heating rotator and the pressure rotator. With this separating member, a recording medium having a toner image fixed thereto is prevented from being wound around the heating rotator or the pressure rotator.

In such a fixing device, a metal roller that does not have any elastic material such as rubber on its outer circumferential surface and has a reduced outer circumferential thickness is used as the heating rotator. The heating rotator formed with such a metal roller is quickly heated, and a toner image can be thermally fixed to a recording medium with high efficiently in a short period of time.

In the case of such a heating rotator formed with a metal roller that does not have any elastic material such as rubber on its outer circumferential surface and has a reduced outer circumferential thickness, the outer circumferential surface is not deformed like rubber, and therefore, the characteristics of separation of a recording medium from the heating rotator becomes poorer. Therefore, when a recording medium having a toner image fixed thereto is separated from such a heating rotator with a separating member, the separating member needs to be brought into contact with the outer circumferential surface of the metal roller, or the separating member needs to be brought very close to the outer circumferential surface of the metal roller.

In a case where the separating member is brought into contact with the outer circumferential surface of the metal roller, however, the separating member leaves a streaky surface on the outer circumference of the metal roller, resulting in streaky noise in a formed image. Also, in a case where a metal roller having a reduced outer circumferential thickness is used as the heating rotator as described above, the heating rotator formed with the metal roller is greatly deformed when the pressure rotator is pressed against the heating rotator. If a separating member is brought very close to the outer circumferential surface of the heating rotator in such a state, the separating member comes into contact with the outer circumferential surface of the heating rotator when the greatly deformed heating rotator regains its original state after the pressure rotator is separated from the heating rotator to clear a jam or the like. As a result, the outer circumferential surface of the heating rotator is scratched, and noise appears in the formed image.

To counter this, JP 2002-91221 A, JP 2007-225754 A, JP 2014-215355 A, and JP 2015-28582 A each disclose a technology by which a separating member located close to the outer circumferential surface of a heating rotator is moved away from the outer circumferential surface of the heating rotator in synchronization with an operation to separate a pressure rotator from the heating rotator against which the pressure rotator has been pressed as described above.

However, in a case where the separating member is moved away from the outer circumferential surface of the heating rotator in synchronization with an operation to separate the pressure rotator from the heating rotator against which the pressure rotator has been pressed, the separating member might come into contact with the outer circumferential surface of the heating rotator and scratch the outer circumferential surface of the heating rotator when the deformed heating rotator regains its original state. Particularly, in a case where the pressure rotator is pressed against a heating rotator formed with a metal roller having a reduced outer circumferential thickness as described above, the deformation of the heating rotator is greater. If the pressure rotator is separated from the heating rotator while the separating member is located very close to the outer circumferential surface of the heating rotator as described above, the separating member comes into contact with the outer circumferential surface of the heating rotator and scratches the outer circumferential surface of the heating rotator before moving away from the outer circumferential surface of the heating rotator.

SUMMARY OF THE INVENTION

The present invention aims to solve the above problems that are caused in a case where a separating member for separating a recording medium having a toner image thermally fixed thereto can be brought close to and moved away from the nip portion between a heating rotator and a pressure rotator in a fixing device in which the heating rotator and the pressure rotator that can be pressed against each other and be separated from each other are rotated while being pressed against each other, and the toner image formed on the recording medium is thermally fixed at the nip portion between the heating rotator and the pressure rotator.

That is, the present invention aims to prevent the separating member from coming into contact with the heating rotator and the pressure rotator, and from scratching these rotators, when the heating rotator and the pressure rotator pressed against each other are separated from each other, and when the heating rotator and the pressure rotator in a separated state are pressed against each other in the above described fixing device. The present invention is to enable excellent image formation in a stable manner.

To achieve at least one of the abovementioned objects, according to an aspect, a fixing device reflecting one aspect of the present invention comprises: a heating rotator and a pressure rotator configured to be pressed against each other and be separated from each other, the heating rotator and the pressure rotator being rotated while being pressed against each other to thermally fix a toner image formed on a recording medium at a nip portion between the heating rotator and the pressure rotator; and a separating member configured to separate the recording medium to which the toner image is thermally fixed, the separating member being enabled to be brought close to and be separated from the nip portion between the heating rotator and the pressure rotator, wherein when the heating rotator and the pressure rotator in a pressure contact state are separated from each other, the heating rotator and the pressure rotator are separated after the separating member is moved away from the nip portion, and when the heating rotator and the pressure rotator in a separated state are pressed against each other, the separating member is brought close to the nip portion after the heating rotator and the pressure rotator are pressed against each other.

As described above, in a case where the heating rotator and the pressure rotator pressed against each other are separated from each other, the heating rotator and the pressure rotator are separated from each other after the separating member is moved away from the nip portion. In this manner, the separating member can be prevented from coming into contact with the heating rotator and the pressure rotator, even if the heating rotator and the pressure rotator that have been pressed against each other and been deformed regain their original states. Also, in a case where the heating rotator and the pressure rotator in a separated state are pressed against each other, the separating member is brought close to the nip portion after the heating rotator and the pressure rotator are pressed against each other. In this manner, contact of the separating member with the heating rotator and the pressure rotator is prevented even if the heating rotator and the pressure rotator are pressed against each other and are deformed.

Here, in a fixing device according to an embodiment of the present invention, the operation is preferably performed when a jam is cleared by removing a recording medium jammed at the nip portion. In a fixing device according to an embodiment of the present invention, the above described operation can also be performed when there is no jam to be cleared. For example, the above described operation can be performed when maintenance is performed on the heating rotator, the pressure rotator, and the separating member.

In a fixing device according to an embodiment of the present invention, generally, the pressure rotator is preferably moved to bring the heating rotator and the pressure rotator into pressure contact with each other or separate the heating rotator and the pressure rotator from each other, and to bring the separating member close to the heating rotator or move the separating member away from the heating rotator.

In a fixing device according to an embodiment of the present invention, various means can be used in performing the above described operation.

The fixing device preferably further comprises, as first means, a lever member having a first operating portion and a second operating portion, wherein when the heating rotator and the pressure rotator in a pressure contact state are separated from each other, the lever member is preferably rotationally moved to separate the heating rotator and the pressure rotator from each other with the second operating portion of the lever member after moving the separating member away from the nip portion with the first operating portion of the lever member, and when the heating rotator and the pressure rotator in a separated state are pressed against each other, the lever member is preferably rotationally moved to bring the separating member close to the nip portion with the first operating portion of the lever member after pressing the heating rotator and the pressure rotator against each other with the second operating portion of the lever member.

The fixing device preferably further comprises, as second means, two lever members, wherein when the heating rotator and the pressure rotator in a pressure contact state are separated from each other, a second lever member of the two lever members is preferably rotationally moved to separate the heating rotator and the pressure rotator from each other after a first lever member of the two lever members is rotationally moved to move the separating member away from the nip portion, and when the heating rotator and the pressure rotator in a separated state are pressed against each other, the first lever member is preferably rotationally moved to bring the separating member close to the nip portion after the second lever member is rotationally moved to press the heating rotator and the pressure rotator against each other.

The fixing device preferably further comprises, as third means: a first drive unit configured to press the heating rotator and the pressure rotator against each other, and separate the heating rotator and the pressure rotator from each other; a second drive unit configured to bring the separating member close to the nip portion, and move the separating member away from the nip portion; and a control unit configured to control driving of the first drive unit and the second drive unit.

In a fixing device according to an embodiment of the present invention, a plurality of separating members is preferably arranged at a predetermined interval in a longitudinal direction of the nip portion, and the separating member at a predetermined location is preferably brought close to the nip portion and is separated from the nip portion. For example, only the separating member located at a portion that is greatly deformed when the heating rotator and the pressure rotator are pressed against each other or are separated from each other can be brought close to the nip portion and be moved away from the nip portion.

To achieve at least one of the abovementioned objects, according to an aspect, an image forming apparatus reflecting one aspect of the present invention comprises the fixing device described above.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIGS. 4A through 4C show situations where the pressure rotator is pressed against the heating rotator or is separated from the heating rotator, and the separating member is brought close to the heating rotator or is separated from the heating rotator in the fixing device according to the embodiment, wherein FIG. 4A is a schematic explanatory diagram showing a situation where the pressure rotator is pressed against the heating rotator, and the separating member is brought close to the heating rotator, FIG. 4B is a schematic explanatory diagram showing a situation where the pressure rotator is pressed against the heating rotator, and the separating member is moved away from the heating rotator, and FIG. 4C is a schematic explanatory diagram showing a situation where the separating member is moved away from the heating rotator, and the pressure rotator is separated from the heating rotator;

DESCRIPTION OF THE PREFERRED EMBODIMENTS

Hereinafter, a fixing device and an image forming apparatus using the fixing device according to an embodiment of the present invention will be described in detail with reference to the drawings. However, the scope of the invention is not limited to the illustrated examples. Fixing devices and image forming apparatuses according to embodiments of the present invention are not limited to those of the embodiment described below, and modifications may be made to the embodiment as appropriate, without departing from the scope of the invention.

Figure 1:
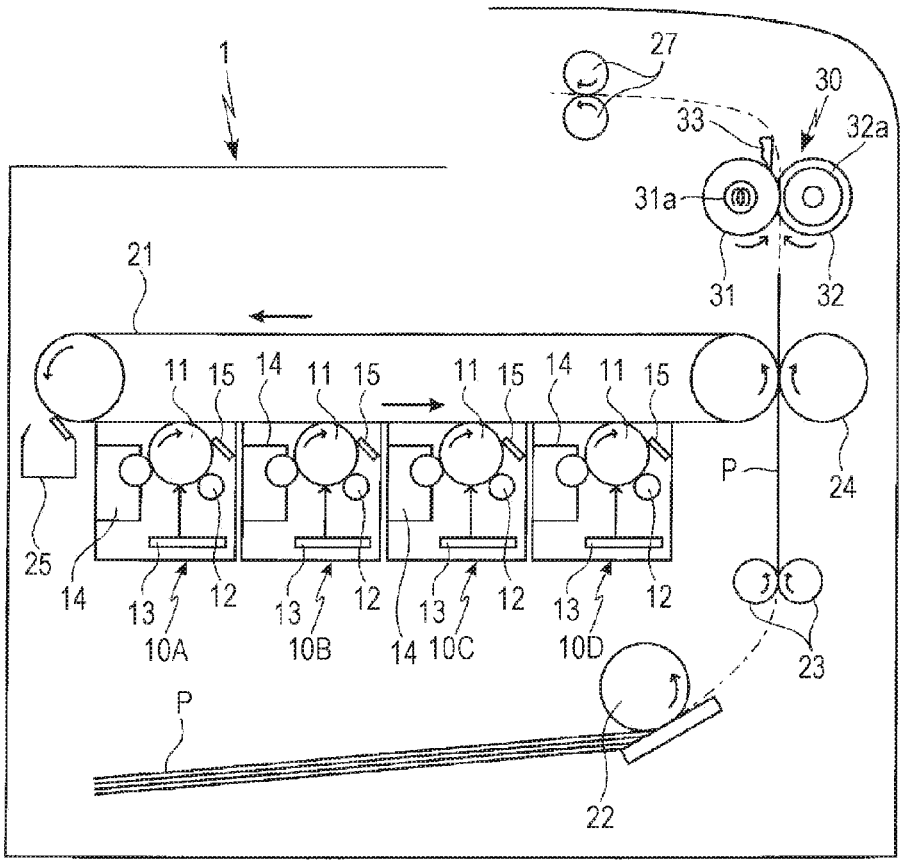
FIG. 1 is a schematic explanatory diagram showing an example of an image forming apparatus using a fixing device according to an embodiment of the present invention.

As shown in FIG. 1, an image forming apparatus 1 of this embodiment includes four imaging cartridges 10A through 10D.

Each of the imaging cartridges 10A through 10D includes: a photosensitive member 11; a charging device 12 that electrically charges the surfaces of the photosensitive member 11; an exposure device 13 that exposes the electrically charged surface of the photosensitive member 11 in accordance with image information, to form an electrostatic latent image on the surface of the photosensitive member 11; a developing device 14 that supplies toner to the electrostatic latent image formed on the surface of the photosensitive member 11, to form a toner image; and a cleaning device 15 that removes toner remaining on the surface of the photosensitive member 11 after the toner image formed on the surface of the photosensitive member 11 is transferred onto an intermediate transfer belt 21.

The respective developing devices 14 of the imaging cartridges 10A through 10D contain toners in different colors from one another. The colors of the toners contained in the developing devices 14 are black, yellow, magenta, and cyan.

In each of the imaging cartridges 10A through 10D in the image forming apparatus 1, the surface of the photosensitive member 11 is electrically charged by the charging device 12, the electrically charged surface of the photosensitive member 11 is exposed by the exposure device 13 in accordance with image information, an electrostatic latent image corresponding to the image information is formed on the surface of the photosensitive member 11, and a toner in the corresponding color is supplied from the developing device 14 onto the electrostatic latent image formed on the surface of the photosensitive member 11, so that a toner image in the corresponding color is formed on the surface of the photosensitive member 11.

The toner images in the respective colors formed on the surfaces of the respective photosensitive members 11 in the imaging cartridges 10A through 10D are then transferred onto the intermediate transfer belt 21 one by one, so that a combined toner image is formed on this intermediate transfer belt 21. After the transfer, the toner remaining on the surface of each photosensitive member 11 is removed from the surface of each photosensitive member 11 by the cleaning device 15.

Meanwhile, a recording medium P stored in the image forming apparatus 1 is supplied by a sheet feed roller 22 and is guided to timing rollers 23. The recording medium P is guided to the portion between the intermediate transfer belt 21 and a transfer roller 24 by the timing rollers 23 at an appropriate time, so that the above described toner image formed on the intermediate transfer belt 21 is transferred onto this recording medium P. The toner that has not been transferred onto the recording medium P and remains on the intermediate transfer belt 21 is removed from the intermediate transfer belt 21 by a second cleaning device 25.

The recording medium P having the toner image transferred thereonto in the above described manner is also guided to a fixing device 30, and the toner image is fixed to the recording medium P by the fixing device 30. After that, the recording medium P having the toner image fixed thereto is discharged by discharge rollers 27.

Figure 2:
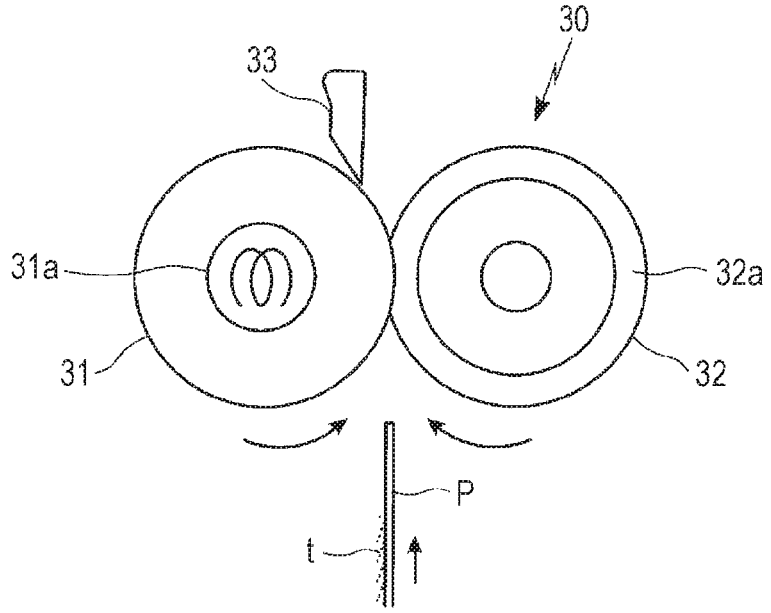
FIG. 2 is a schematic explanatory diagram showing a situation where a heating rotator and a pressure rotator are rotated while being pressed against each other, and a separating member is brought close to the heating rotator, before a toner image is fixed to a recording medium in the fixing device according to the embodiment of the present invention.

As shown in FIGS. 1 and 2, in the fixing device 30 according to this embodiment, a heating rotator 31 and a pressure rotator 32 are rotated while being pressed against each other. Also, a separating member 33 is brought close to the heating rotator 31, and a recording medium P having a toner image t transferred thereonto is guided to the nip portion between the heating rotator 31 and the pressure rotator 32. The recording medium P is heated and pressed at this nip portion, so that the toner image t is fixed to the recording medium P. Also, the recording medium P having the toner image t fixed thereto is separated from the heating rotator 31 by the separating member 33.

Also, in the fixing device 30 according to this embodiment, a heating roller having a heating unit 31*a* such as a halogen lamp installed therein is used as the heating rotator 31, while a pressure roller having an elastic member 32*a* provided on its outer circumference is used as the pressure rotator 32. A metal roller or the like having an outer circumferential surface with a reduced thickness is used as the heating roller in the heating rotator 31 so that the heating roller can be quickly heated by the heating unit 31*a* and can thermally fix the toner image t to the recording medium P with high efficiency in a short period of time. In this embodiment, the heating rotator 31 and the pressure rotator 32 are formed with rollers, but these rotators are not limited to rollers. For example, the heating rotator 31 and the pressure rotator 32 may be formed with a structure in which an endless belt is stretched around rollers and is rotated.

Figure 3:
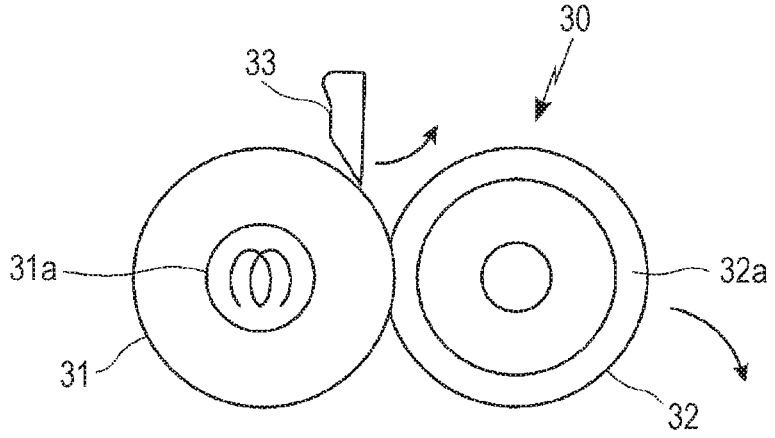
FIG. 3 is a schematic explanatory diagram showing that the pressure rotator is pressed against the heating rotator or is separated from the heating rotator, and the separating member is brought close to the heating rotator or is moved away from the heating rotator in the fixing device according to the embodiment.

Also, in the fixing device 30 according to this embodiment, the pressure rotator 32 is movable relative to the heating rotator 31, as shown in FIG. 3. This pressure rotator 32 is pressed against the heating rotator 31 or is separated from the heating rotator 31. The separating member 33 is also movable relative to the heating rotator 31. This separating member 33 is brought close to the heating rotator 31 or is moved away from the heating rotator 31.

Next, an operation to clear a jam by removing a jammed recording medium P from between the heating rotator 31 and the pressure rotator 32 in the fixing device 30 according to this embodiment is described. This operation is performed in a case where the recording medium P is jammed between the heating rotator 31 and the pressure rotator 32 when the heating rotator 31 and the pressure rotator 32 are rotated while being pressed against each other, the separating member 33 is brought close to the heating rotator 31, and the recording medium P is heated and pressed at the nip portion between the heating rotator 31 and the pressure rotator 32 so that the toner image t is fixed to the recording medium P.

Figure 4A:
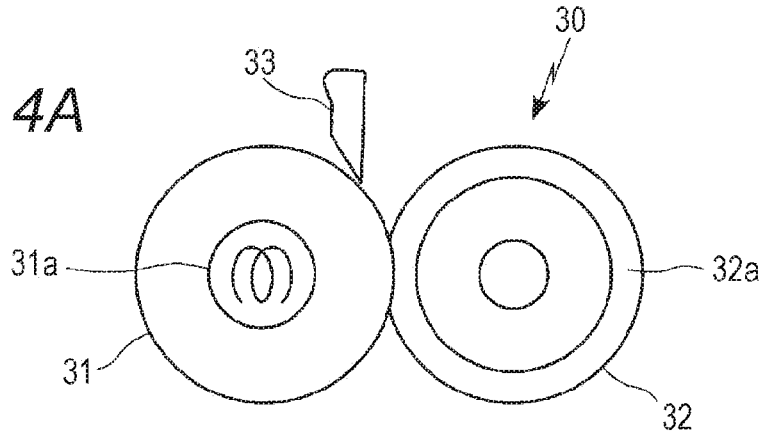
Figure 4B:
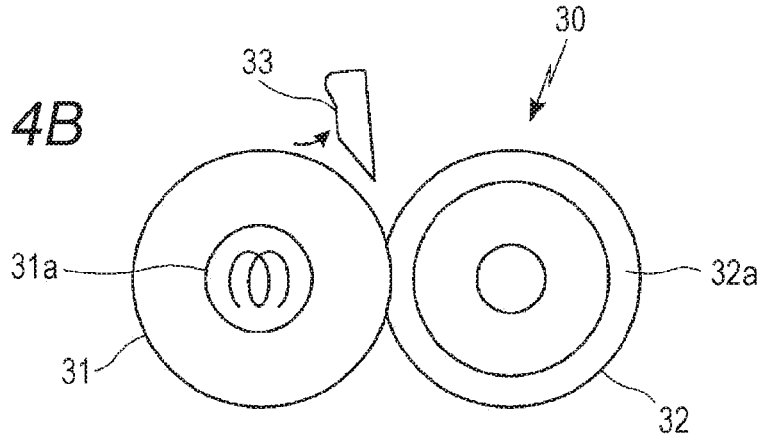
Figure 4C:
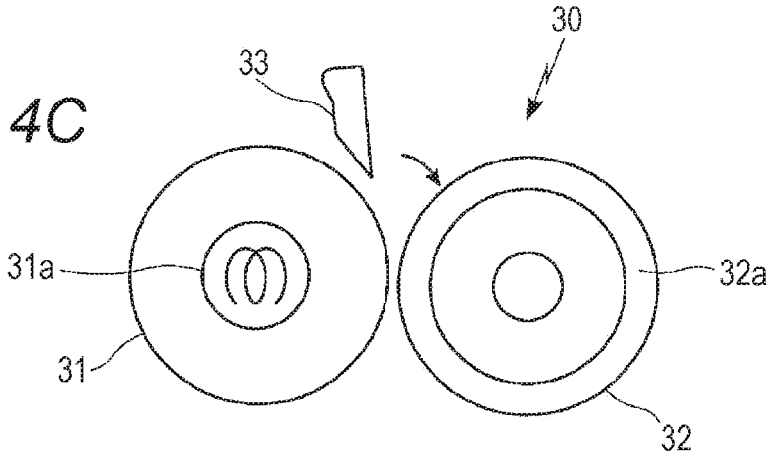

In the fixing device 30 according to this embodiment, the heating rotator 31 and the pressure rotator 32 are pressed against each other, and the separating member 33 is brought close to the heating rotator 31, as shown in FIG. 4A. In this situation, the separating member 33 brought close to the heating rotator 31 is first moved away from the heating rotator 31 while the heating rotator 31 and the pressure rotator 32 remain pressed against each other, as shown in FIG. 4B. After that, the pressure rotator 32 is moved in a direction away from the heating rotator 31, so that the pressure rotator 32 is separated from the heating rotator 31, as shown in FIG. 4C. In this process, the separating member 33 is kept away from the heating rotator 31. Accordingly, even if the pressed and deformed heating rotator 31 regains its original state when the pressure rotator 32 is separated from the heating rotator 31, contact of the separating member 33 with the heating rotator 31 can be prevented.

Before the heating rotator 31 and the pressure rotator 32 are pressed against each other to resume the fixing operation after the recording medium P jammed between the heating rotator 31 and the pressure rotator 32 is removed and the jam is cleared as described above, the separating member 33 is kept away from the heating rotator 31, and the pressure rotator 32 is also kept away from the heating rotator 31, as shown in FIG. 4C. The pressure rotator 32 separated from the heating rotator 31 is then moved toward the heating rotator 31 and is pressed against the heating rotator 31 while the separating member 33 is kept away from the heating rotator 31, as shown in FIG. 4B. After that, the separating member 33 is brought close to the heating rotator 31, as show in FIG. 4A. In this process, the separating member 33 is kept away from the heating rotator 31 when the pressure rotator 32 is pressed against the heating rotator 31. Accordingly, even if the heating rotator 31 is pressed by the pressure rotator 32 and is deformed, contact of the separating member 33 with the heating rotator 31 can be prevented.

Next, specific example cases where a jam is cleared as a recording medium P jammed between the heating rotator 31 and the pressure rotator 32 as described above is removed are described.

Figure 5:
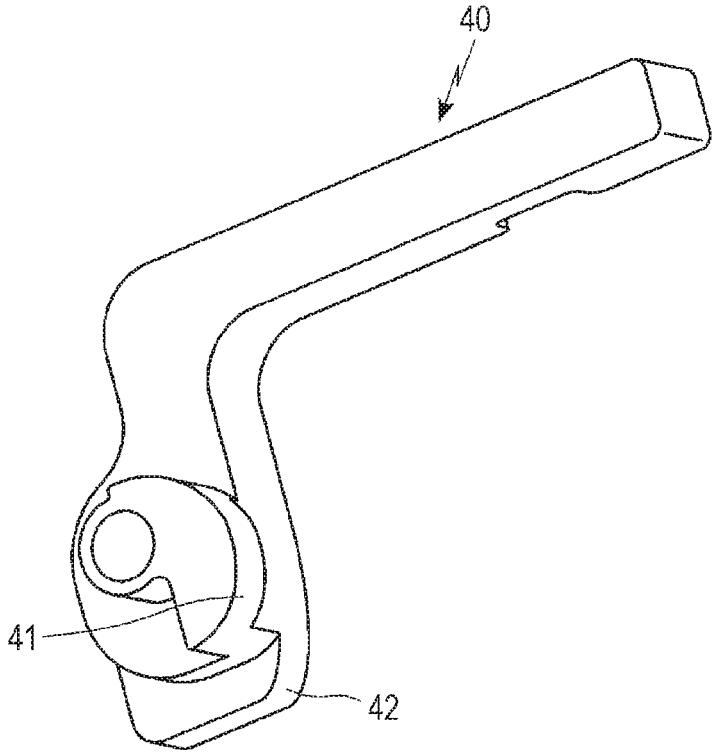
FIG. 5 is a schematic explanatory diagram showing a lever member having two operating portions that are used in a first example where a recording medium jammed between the heating rotator and the pressure rotator is removed to clear a jam in the fixing device according to the embodiment.

In a first example, a lever member 40 having a first operating portion 41 and a second operating portion 42 as shown in FIG. 5 is used.

Figure 6:
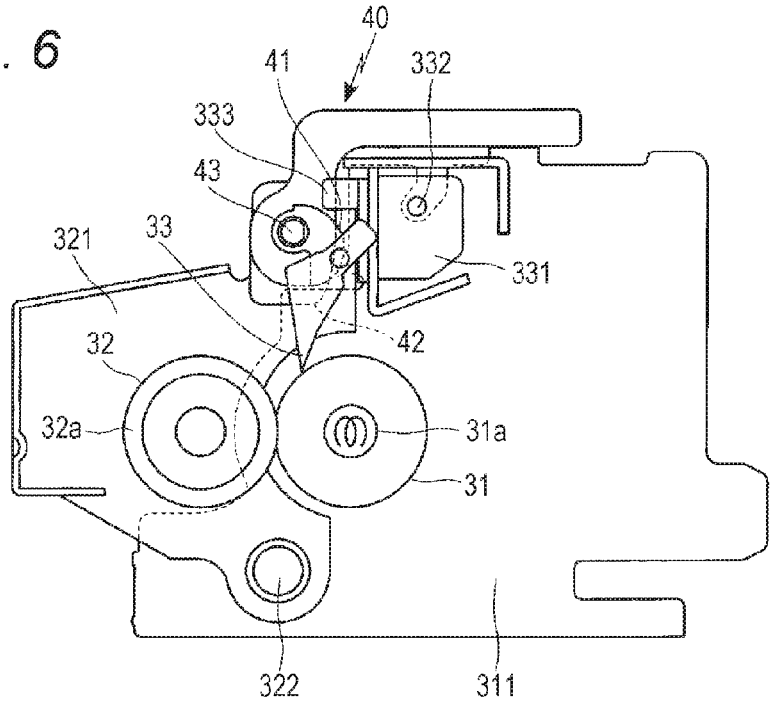
FIG. 6 is a schematic explanatory diagram showing a situation where the pressure rotator is pressed against the heating rotator, and the separating member is located close to the heating rotator, before the lever member is rotationally moved in the first example.

In this first example, as shown in FIG. 6, the lever member 40 is rotatably attached, with an attaching shaft 43, to a pressing-side holding plate 321 rotatably holding the pressure rotator 32. This pressing-side holding plate 321 is rotatably attached, with an attaching shaft 322, to a heating-side holding plate 311 rotatably holding the heating rotator 31, and the pressing-side holding plate 321 is pushed toward the heating-side holding plate 311 so that the pressure rotator 32 is moved toward the heating rotator 31.

The separating member 33 is held by a holding member 331, and this holding member 331 is rotatably attached, with an attaching shaft 332, to the heating-side holding plate 311 so that the separating member 33 can be brought close to the heating rotator 31 or be moved away from the heating rotator 31. This holding member 331 is pushed so that the separating member 33 is brought close to the heating rotator 31.

The first operating portion 41 of the lever member 40 is in contact with a contact portion 333 of the holding member 331, and the second operating portion 42 of the lever member 40 is in contact with an end face of the heating-side holding plate 311.

In the first example, during a fixing operation in which the heating rotator 31 and the pressure rotator 32 are rotated while being pressed against each other, and the separating member 33 is brought close to the heating rotator 31, the first operating portion 41 of the lever member 40 does not press the contact portion 333 of the holding member 331, and the second operating portion 42 of the lever member 40 does not press the heating-side holding plate 311, as shown in FIG. 6.

Figure 7:
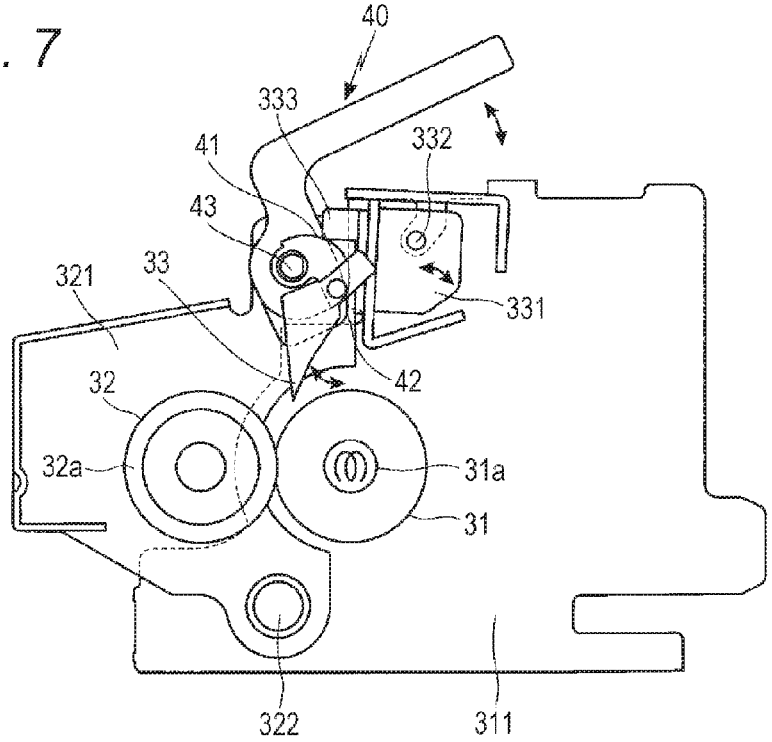
FIG. 7 is a schematic explanatory diagram showing a situation where the lever member is rotationally moved by a certain amount in the first example, so that the separating member is moved away from the heating rotator while the pressure rotator remains pressed against the heating rotator.

In this first example, when a recording medium P jammed between the heating rotator 31 and the pressure rotator 32 is removed to clear a jam in a situation where the heating rotator 31 and the pressure rotator 32 are pressed against each other while the separating member 33 is located close to the heating rotator 31 as shown in FIG. 6, the lever member 40 is rotated by a certain amount, and the contact portion 333 of the holding member 331 is pushed by the first operating portion 41 of the lever member 40, as shown in FIG. 7. The holding member 331 pushed so as to bring the separating member 33 close to the heating rotator 31 is rotationally moved in such a direction that the separating member 33 moves away from the heating rotator 31. In this manner, the separating member 33 is moved away from the heating rotator 31. In this situation, the second operating portion 42 of the lever member 40 does not press the heating-side holding plate 311, and the heating rotator 31 and the pressure rotator 32 are kept pressed against each other.

Figure 8:
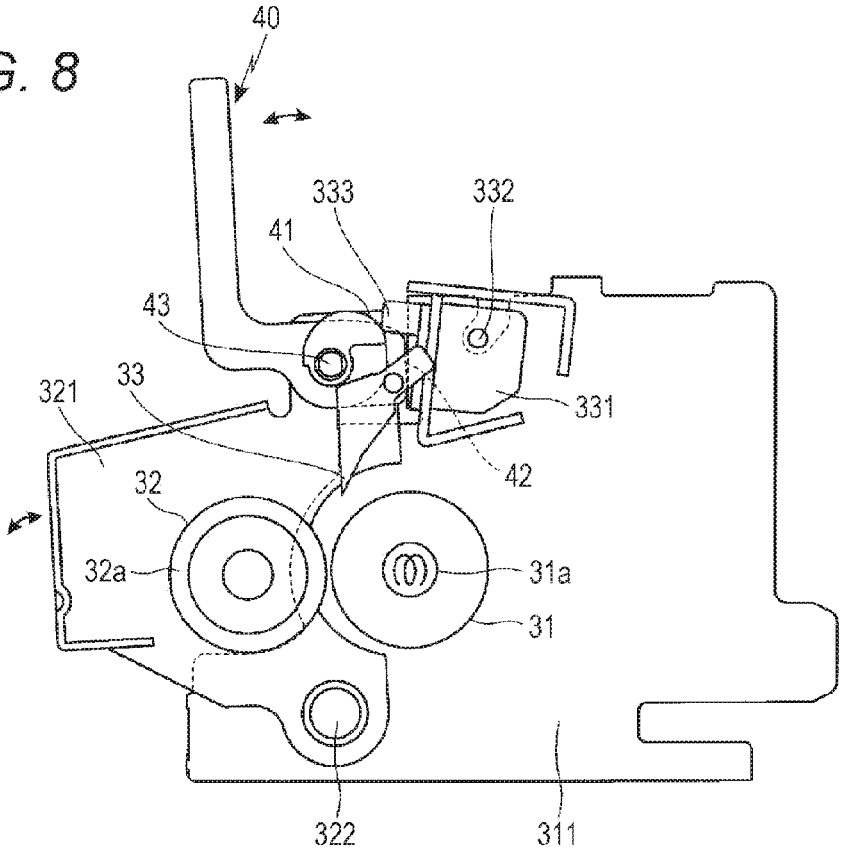
FIG. 8 is a schematic explanatory diagram showing a situation where the lever member is further rotationally moved in the first example, so that the separating member is moved away from the heating rotator, and the pressure rotator is separated from the heating rotator.

With the separating member 33 being kept away from the heating rotator 31 as described above, the lever member 40 is further rotationally moved, and the pressing-side holding plate 321 pushed toward the heating-side holding plate 311 by the second operating portion 42 of the lever member 40 is rotationally moved in a direction away from the heating-side holding plate 311, so that the pressure rotator 32 pressed against the heating rotator 31 is separated from the heating rotator 31, as shown in FIG. 8. The recording medium P jammed between the heating rotator 31 and the pressure rotator 32 is then removed. In this process, the separating member 33 is kept away from the heating rotator 31 when the heating rotator 31 and the pressure rotator 32 pressed against each other are separated. Accordingly, even if the deformed heating rotator 31 regains its original state as the contact pressure is removed, contact of the separating member 33 with the heating rotator 31 is prevented.

When the fixing operation is resumed after the recording medium P jammed between the heating rotator 31 and the pressure rotator 32 is removed in the above manner, the lever member 40 is rotated in the reverse direction, as shown in FIG. 8, while the pressure rotator 32 is kept away from the heating rotator 31, and the separating member 33 is also kept away from the heating rotator 31. With the separating member 33 being kept away from the heating rotator 31, the pressure rotator 32 is moved toward the heating rotator 31, and the heating rotator 31 and the pressure rotator 32 are pressed against each other, as shown in FIG. 7.

After that, the lever member 40 is further rotated in the reverse direction, and the separating member 33 kept away from the heating rotator 31 is brought close to the heating rotator 31, as shown in FIG. 6. The fixing operation is then resumed. In this process, the separating member 33 is kept away from the heating rotator 31 when the pressure rotator 32 is pressed against the heating rotator 31. Accordingly, even if the heating rotator 31 is deformed when the pressure rotator 32 is pressed against the heating rotator 31, contact of the separating member 33 with the heating rotator 31 is prevented.

In this first example, the single lever member 40 having the first operating portion 41 and the second operating portion 42 as shown in FIG. 5 is used, and the single lever member 40 is rotationally moved, to press the pressure rotator 32 against the heating rotator 31 or separate the pressure rotator 32 from the heating rotator 31, and to bring the separating member 33 close to the heating rotator 31 or move the separating member 33 away from the heating rotator 31 as described above. However, the single lever member 40 does not necessarily have the first operating portion 41 and the second operating portion 42.

Figure 9:
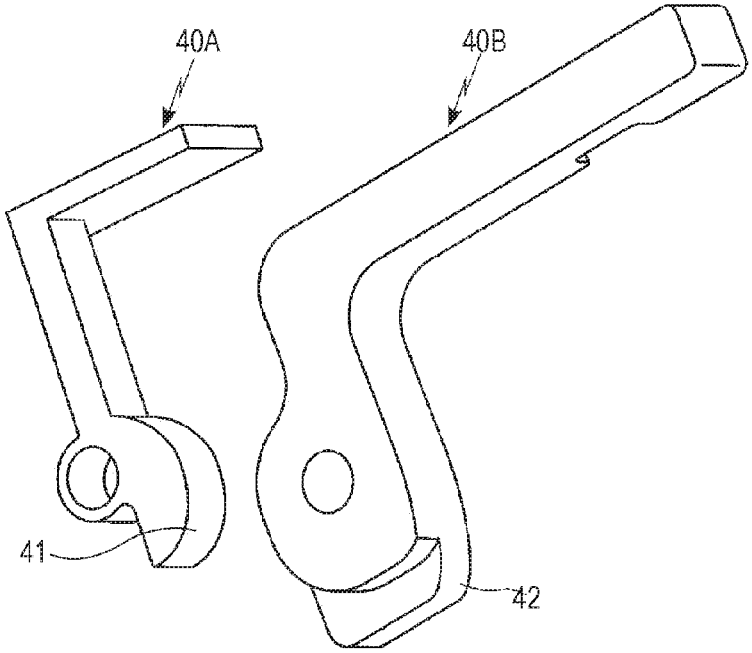
FIG. 9 is a schematic explanatory diagram showing a modification in which the lever member of the first example is divided into a first lever member including a first operating portion and a second lever member including a second operating portion.

For example, the above described lever member 40 may be divided into a first lever member 40A including the first operating portion 41 and a second lever member 40B including the second operating portion 42, as shown in FIG. 9. In such a case, the first lever member 40A and the second lever member 40B are rotationally moved independently of each other, to press the pressure rotator 32 against the heating rotator 31 or separate the pressure rotator 32 from the heating rotator 31, and to bring the separating member 33 close to the heating rotator 31 or move the separating member 33 away from the heating rotator 31.

Figure 10:
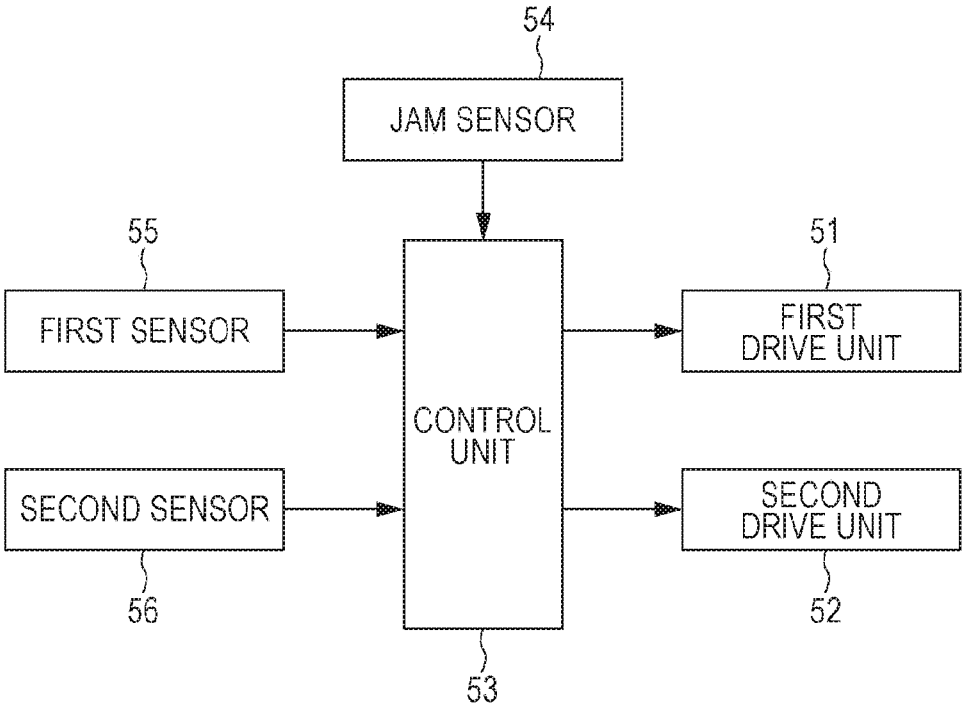
FIG. 10 is a block diagram schematically showing the configuration of a second example where a recording medium jammed between the heating rotator and the pressure rotator is removed to clear a jam in the fixing device according to the embodiment.

In a second example shown in FIG. 10, a first drive unit 51 presses the heating rotator 31 and the pressure rotator 32 against each other or separates the heating rotator 31 and the pressure rotator 32 from each other. A second drive unit 52 brings the separating member 33 close to the heating rotator 31 or moves the separating member 33 away from the heating rotator 31. A control unit 53 controls the drive operations of the first drive unit 51 and the second drive unit 52. A jam sensor 54 senses a jam between the heating rotator 31 and the pressure rotator 32. A first sensor 55 senses a pressure contact state or a separated state between the heating rotator 31 and the pressure rotator 32. A second sensor 56 senses proximity or a separated state of the separating member 33 with respect to the heating rotator 31. Results of the sensing performed by the jam sensor 54, the first sensor 55, and the second sensor 56 are output to the control unit 53.

Figure 11:
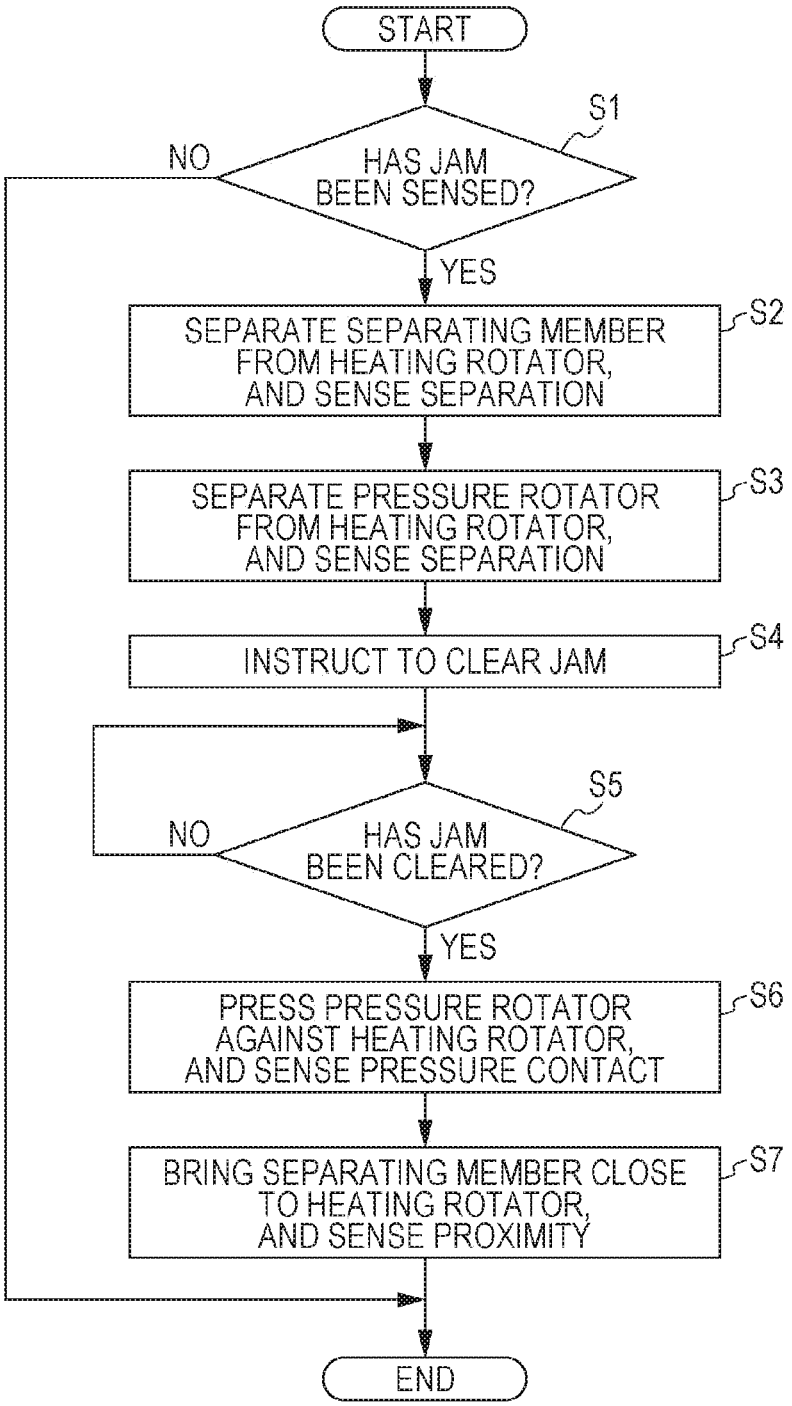
FIG. 11 is a flowchart showing a jam clearing control operation in the second example.

Referring now to the flowchart shown in FIG. 11, a jam clearing control operation in the second example is described.

First, the jam sensor 54 searches for an occurrence of a jam (S1). If any jam is not sensed, jam clearing control is not performed, and the operation comes to an end.

If an occurrence of a jam is sensed, on the other hand, the result is output from the jam sensor 54 to the control unit 53. The control unit 53 causes the second drive unit 52 to move the separating member 33 located close to the heating rotator 31 away from the heating rotator 31, and this is sensed by the second sensor 56 (S2). After that, the control unit 53 causes the first drive unit 51 to separate the heating rotator 31 and the pressure rotator 32 in a pressure contact state from each other, and this is sensed by the first sensor 55 (S3).

After that, a jam clearing instruction is issued (S4), and the jam sensor 54 repeatedly determines whether the jam has been cleared (S5). If the jam has been cleared, the control unit 53 causes the first drive unit 51 to press the heating rotator 31 and the pressure rotator 32 in a separated state against each other, and this is sensed by the first sensor 55 (S6). After that, the control unit 53 causes the second drive unit 52 to bring the separating member 33 kept away from the heating rotator 31 close to the heating rotator 31, and this is sensed by the second sensor 56 (S7). The jam clearing control operation then comes to an end.

In this case, before the heating rotator 31 and the pressure rotator 32 pressed against each other are separated from each other, the separating member 33 located close to the heating rotator 31 is moved away from the heating rotator 31. After that, the heating rotator 31 and the pressure rotator 32 pressed against each other are separated from each other, as in the first example. Thus, contact of the separating member 33 with the heating rotator 31 is prevented when the heating rotator 31 and the pressure rotator 32 are separated. Also, when the heating rotator 31 and the pressure rotator 32 in a separated state are pressed against each other, the separating member 33 is kept away from the heating rotator 31. After the heating rotator 31 and the pressure rotator 32 are pressed against each other, the separating member 33 kept away from the heating rotator 31 is brought close to the heating rotator 31. Thus, contact of the separating member 33 with the heating rotator 31 is prevented when the heating rotator 31 and the pressure rotator 32 are pressed against each other.

Figure 12:
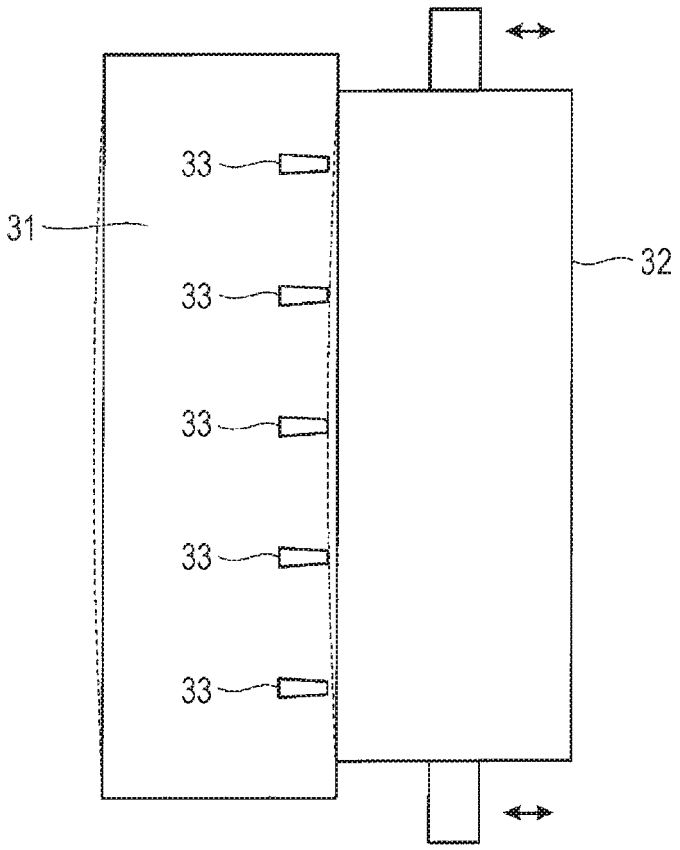
FIG. 12 is a schematic plan view showing an example where separating members are located close to the heating rotator and arranged at predetermined intervals in the longitudinal direction of the nip portion between the heating rotator and the pressure rotator in the fixing device according to the embodiment.

In the fixing device 30 according to the above described embodiment, more than one separating member 33 may be located close to the heating rotator and be arranged at predetermined intervals in the longitudinal direction of the nip portion between the heating rotator 31 and the pressure rotator 32, as shown in FIG. 12. In this case, only the separating member 33 located at a portion that might be brought into contact with the heating rotator 31 when the pressure rotator 32 is pressed against the heating rotator 31 or is separated from the heating rotator 31 as described above can be brought close to the heating rotator 31 or be moved away from the heating rotator 31. Specifically, only the separating member 33 located at a central portion in the axial direction of the heating rotator 31 can be brought close to the heating rotator 31 or be moved away from the heating rotator 31, because such a central portion is greatly deformed.

According to an embodiment of the present invention, in a fixing device, before a heating rotator and a pressure rotator pressed against each other as described above are separated, a separating member is moved away from the nip portion between the heating rotator and the pressure rotator. After that, the heating rotator and the pressure rotator are separated from each other. In a case where the heating rotator and the pressure rotator in a separated state are pressed against each other, the separating member is brought close to the nip portion after the heating rotator and the pressure rotator are pressed against each other.

As a result, in the fixing device according to an embodiment of the present invention, contact of the separating member with the heating rotator and the pressure rotator is prevented when the heating rotator and the pressure rotator pressed against each other are separated from each other. Also, contact of the separating member with the heating rotator and the pressure rotator is prevented when the heating rotator and the pressure rotator in a separated state are pressed against each other. Further, when a jam is cleared by removing a recording medium jammed at the nip portion, the separating member is prevented from coming into contact with the heating rotator and the pressure rotator, and from scratching the heating rotator and the pressure rotator. Thus, excellent image formation can be performed in a stable manner.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A fixing device comprising:

a heating rotator and a pressure rotator configured to be pressed against each other and be separated from each other by a first operating mechanism, the heating rotator and the pressure rotator being rotated while being pressed against each other to thermally fix a toner image formed on a recording medium at a nip portion between the heating rotator and the pressure rotator; and a separating member configured to separate the recording medium to which the toner image is thermally fixed, the separating member being enabled to be brought close to and be separated from the nip portion between the heating rotator and the pressure rotator by a second operating mechanism, wherein the first operating mechanism and the second operating mechanism are interconnected and configured so that when the heating rotator and the pressure rotator in a pressure contact state are separated from each other, the heating rotator and the pressure rotator are separated after the separating member is moved away from the nip portion, and so that when the heating rotator and the pressure rotator in a separated state are pressed against each other, the separating member is brought close to the nip portion only after the heating rotator and the pressure rotator are pressed against each other.

2. The fixing device according to claim 1, wherein the operation is performed when a jam is cleared by removing a recording medium jammed at the nip portion.

3. The fixing device according to claim 1, wherein the pressure rotator is moved to bring the heating rotator and the pressure rotator into pressure contact with each other or separate the heating rotator and the pressure rotator from each other, and to bring the separating member close to the heating rotator or move the separating member away from the heating rotator.

4. The fixing device according to claim 1, further comprising a lever having the first operating mechanism and the second operating mechanism, wherein when the heating rotator and the pressure rotator in a pressure contact state are separated from each other, the lever is rotationally moved to separate the heating rotator and the pressure rotator from each other with the first operating mechanism of the lever after moving the separating member away from the nip portion with the second operating mechanism of the lever, and when the heating rotator and the pressure rotator in a separated state are pressed against each other, the lever is rotationally moved to bring the separating member close to the nip portion with the second operating mechanism of the lever after pressing the heating rotator and the pressure rotator against each other with the first operating mechanism of the lever.

5. The fixing device according to claim 1, further comprising a first lever and a second lever, the first operating mechanism being arranged on the first lever and the second operating mechanism being arranged on the second lever, the first lever and the second lever being interconnected and configured so that, when the heating rotator and the pressure rotator in a pressure contact state are separated from each other, the first lever member is rotationally moved to separate the heating rotator and the pressure rotator from each other after the second lever is rotationally moved to move the separating member away from the nip portion, and when the heating rotator and the pressure rotator in a separated state are pressed against each other, the second lever is rotationally moved to bring the separating member close to the nip portion after the first lever is rotationally moved to press the heating rotator and the pressure rotator against each other.

6. The fixing device according to claim 1, wherein:

the first operating mechanism includes a first drive unit configured to press the heating rotator and the pressure rotator against each other, and separate the heating rotator and the pressure rotator from each other; and the second operating mechanism includes a second drive unit configured to bring the separating member close to the nip portion, and move the separating member away from the nip portion;

the fixing device further comprising a control unit configured to control driving of the first drive unit and the second drive unit.

7. The fixing device according to claim 1, wherein a plurality of separating members is arranged at a predetermined interval in a longitudinal direction of the nip portion, and the separating member at a predetermined location is brought close to the nip portion and is separated from the nip portion.

8. An image forming apparatus comprising the fixing device according to claim 1.

* * * * *